US011044946B2

(12) United States Patent
Meyer et al.

(10) Patent No.: US 11,044,946 B2
(45) Date of Patent: Jun. 29, 2021

(54) SHISHA DEVICE FOR HEATING A SUBSTRATE WITHOUT COMBUSTION

(71) Applicant: PHILIP MORRIS PRODUCTS S.A., Neuchatel (CH)

(72) Inventors: Cedric Meyer, Lausanne (CH); Samuel Bonnely, Cormondrèche (CH); Angelos Kolyris, St-Sulpice (CH); Stuart Michael Ruan Jones, Royston (GB); John Antony Stephenson, Cambridge (GB); Yaan Thomas Kinally, Cambridge (GB); Michael Paton, Royston (GB); David Cross, Letchworth (GB)

(73) Assignee: Philip Morris Products S.A., Neuchatel (CH)

( * ) Notice: Subject to any disclaimer, the term of this patent is extended or adjusted under 35 U.S.C. 154(b) by 118 days.

(21) Appl. No.: 16/090,439

(22) PCT Filed: Apr. 5, 2017

(86) PCT No.: PCT/IB2017/051968
§ 371 (c)(1),
(2) Date: Oct. 1, 2018

(87) PCT Pub. No.: WO2017/178931
PCT Pub. Date: Oct. 19, 2017

(65) Prior Publication Data

US 2019/0110519 A1 Apr. 18, 2019

(30) Foreign Application Priority Data

Apr. 11, 2016 (EP) ..... 16164764

(51) Int. Cl.
*A24F 47/00* (2020.01)
*A24F 1/30* (2006.01)

(52) U.S. Cl.
CPC ..... *A24F 47/008* (2013.01); *A24F 1/30* (2013.01)

(58) Field of Classification Search
CPC ..... A24F 7/04; A24F 1/30
See application file for complete search history.

(56) References Cited

U.S. PATENT DOCUMENTS 5,179,966 A 1/1993 Losee et al.
8,757,170 B2 6/2014 Kaplani
(Continued)

FOREIGN PATENT DOCUMENTS

CN 102551217 A 7/2012
CN 104023568 A 9/2014
(Continued)

OTHER PUBLICATIONS

Decision to Grant issued by the Federal Service of the Intellectual Property (ROSPATENT), for Russian Application No. 2018135749 dated May 22, 2020; 18 pgs. Including English translation.
(Continued)

*Primary Examiner* — Eric Yaary
*Assistant Examiner* — Jennifer A Kessie
(74) *Attorney, Agent, or Firm* — Mueting Raasch Group

(57) ABSTRACT

A shisha device (100) for use with a cartridge (20) containing an aerosol-generating substrate (302) includes a vessel, a receptacle, and an electrical heating element. The cartridge comprises a housing surrounding the aerosol-generating substrate. The vessel defines an interior configured to contain liquid (19) and defines an outlet in communication with the interior of the vessel. The receptacle is configured to receive the cartridge. The heating element is configured to heat the aerosol-generating substrate in the cartridge to generate an aerosol when the cartridge is received by the receptacle. The heating element is configured to heat the
(Continued)

tobacco substrate to an extent sufficient to generate the aerosol without combusting the aerosol-generating substrate.

13 Claims, 7 Drawing Sheets

(56) References Cited

U.S. PATENT DOCUMENTS

| | | | |
|---|---|---|---|
| 8,983,282 | B2 | 3/2015 | Bishara |
| 2009/0151717 | A1 | 6/2009 | Bowen et al. |
| 2010/0212679 | A1 | 8/2010 | Bishara |
| 2014/0060554 | A1 | 3/2014 | Collett et al. |
| 2014/0083441 | A1 | 3/2014 | Kaplani |
| 2016/0029696 | A1 | 2/2016 | Obeidallah |
| 2016/0066619 | A1 | 3/2016 | Di Carlo |
| 2016/0206001 | A1 | 7/2016 | Eng et al. |

FOREIGN PATENT DOCUMENTS

| | | | |
|---|---|---|---|
| CN | 203952442 | U | 11/2014 |
| EP | 1947965 | B1 | 2/2010 |
| GB | 2519934 | A | 5/2015 |
| WO | WO 2009/118085 | A | 10/2009 |
| WO | WO 2010/061233 | A2 | 6/2010 |
| WO | WO 2013/060743 | A2 | 5/2013 |
| WO | WO 2015/172224 | A1 | 11/2015 |

OTHER PUBLICATIONS

European Search Report for EP 16164764.9, issued by the European Patent Office dated Oct. 12, 2016; 6 pgs.

International Search Report and Written Opinion for PCT/IB2017/051968, issued by the European Patent Office dated Jun. 22, 2017; 14 pgs.

Chinese First Office Action for CN 201780019002.7, issued by the China National Intellectual Property Administration dated Nov. 3, 2020; 18 pgs. including English Translation.

SHISHA DEVICE FOR HEATING A SUBSTRATE WITHOUT COMBUSTION

This application is the § 371 U.S. National Stage of International Application No. PCT/IB2017/051968, filed 5 Apr. 2017, which claims the benefit of European Application No. 16164764.9, filed 11 Apr. 2016.

This disclosure relates to shisha devices; and more particularly to shisha devices configured to heat tobacco without combusting the tobacco.

Shisha devices are used to smoke tobacco and are configured such that vapour and smoke pass through a water basin before inhalation by a consumer. Shisha devices may include one outlet or more than one outlet so that the device can be used by more than one consumer at a time. Use of shisha devices is considered by many to be a leisure activity and a social experience.

The tobacco used in shisha devices may be mixed with other ingredients to, for example, increase the volume of the vapour and smoke produced, to alter flavour, or both. Charcoal pellets are typically used to heat the tobacco in a shisha device, which may cause full or partial combustion of the tobacco or other ingredients.

Some shisha devices have been proposed that use electrical heat sources to combust the tobacco to, for example, avoid by-products of burning charcoal or to improve the consistency with which the tobacco is combusted. Other shisha devices have been proposed that employ e-liquids rather than tobacco. Shisha devices that employ e-liquids eliminate combustion by-products, but deprive shisha consumers of the tobacco-based experience.

It is desirable to provide a shisha device that employs a substrate that does not result in combustion by-products.

It is also desirable to provide a shisha device configured for use with an aerosol-generating substrate, such as a tobacco substrate, in a convenient consumable form.

In various aspects of the present invention there is provided a shisha device for use with one or more cartridges containing an aerosol-generating substrate. The cartridges comprises a housing surrounding the aerosol-generating substrate. The shisha device comprises a vessel, one or more receptacles and one or more electrical heating elements. The vessel defines an interior configured to contain liquid and defines an outlet in communication with the interior of the vessel. At least a first receptacle is configured to receive a cartridge. At least one electrical heating element is configured to heat the aerosol-generating substrate in the cartridge to generate an aerosol when the cartridge is received by the first receptacle. Preferably, the heating element is configured to heat the tobacco substrate to an extent sufficient to generate the aerosol without combusting the aerosol-generating substrate.

Preferably the shisha device comprises at least a second receptacle configured to receive a second cartridge comprising a housing surrounding an aerosol generating substrate, and comprises a second electrical heating element configured to heat the aerosol-generating substrate in the second cartridge to generate an aerosol when the second cartridge is received by the second receptacle. The second heating element is preferably configured to heat the aerosol-generating substrate to an extent sufficient to generate an aerosol without combusting the aerosol-generating substrate. Preferably the first and second heating elements are separately activatable. The shisha device is preferably configured to activate the second heating element in response to approaching the end of the time period for activating the first heating element.

For example, a shisha device according to the invention may comprise three or more receptacles, each configured to receive a cartridge that comprises a housing surrounding an aerosol generating substrate. The device also comprises three or more electrical heating elements, each configured to heat the aerosol-generating substrate in the respective cartridges to generate an aerosol when the cartridges are received by the receptacles, wherein the heating elements are configured to heat the aerosol-generating substrate in the cartridges to an extent sufficient to generate an aerosol without combusting the aerosol-generating substrate. The shisha device is preferably configured to activate the first heating element for a period of time based on a lifetime of the aerosol generating substrate in the first cartridge, and then to activate each electrical heating element in a sequential fashion in response to approaching an end of a lifetime of the aerosol generating substrate in the previously heated cartridge.

In some examples, the device, in use, forms an aerosol flow path configured to carry the aerosol to liquid disposed in the vessel and through the outlet for delivery to a consumer.

In some examples, the heating element extends into the receptacle and is configured to pierce the cartridge when the cartridge is inserted into the receptacle. In other examples, the heating element is actuatable from a first position in which the heating element does not extend into the receptacle to a second position in which the heating element extends into the receptacle. Actuation of the heating element from the first position to the second position may cause the heating element to pierce the cartridge when the cartridge is received by the receptacle. Insertion of the cartridge into the receptacle may cause the heating element to move from the first position to the second position. In yet other examples, the heating element surrounds at least a portion of the cartridge when the cartridge is received by the receptacle.

In some examples, the heating element comprises a plurality of separately activatable zones configured to heat a separate portion of the aerosol-generating substrate in the cartridge. For example, the heating element may comprise one or more heating pins or heating blades that are separately activatable. The separately activatable zones may be sequentially activatable.

In some examples, a shisha device of the invention comprises a puff sensor operably coupled to the heating element and configured to activate the heating element when a consumer draws air through the outlet.

In some examples, a shisha device of the invention comprises an air inlet. In use, the device may comprise a flow path configured to cause air entering the device through the inlet to flow across the aerosol-generating substrate when air is drawn through the outlet.

In some examples, a shisha device of the invention comprises a receptacle configured to receive a second cartridge that is different from the first cartridge. The second cartridge may comprise a flavorant. In use, the device may form an airflow path such that air is drawn over the flavorant and to the outlet without being drawn through the liquid disposed in the vessel. Air drawn over the flavorant may mix with air containing the aerosol constituents resulting from heating the aerosol-generating substrate prior to delivery to the consumer. For example the air may mix at the outlet.

Any suitable aerosol-generating substrate may be used with shisha devices of the invention. The aerosol-generating substrate is preferably a substrate capable of releasing volatile compounds that can form an aerosol. The volatile compounds are released by heating the aerosol-generating substrate. The aerosol-generating substrate may be solid or liquid or comprise both solid and liquid components. In a preferred embodiment, the aerosol-generating substrate is solid.

The aerosol-generating substrate may comprise nicotine. The nicotine containing aerosol-generating substrate may comprise a nicotine salt matrix. The aerosol-generating substrate may comprise plant-based material. The aerosol-generating substrate may comprise tobacco, and preferably the tobacco containing material contains volatile tobacco flavor compounds, which are released from the aerosol-generating substrate upon heating.

The aerosol-generating substrate may comprise homogenized tobacco material. Homogenized tobacco material may be formed by agglomerating particulate tobacco. Where present, the homogenized tobacco material may have an aerosol-former content of equal to or greater than 5% on a dry weight basis, and preferably between greater than 5% and 30% by weight on a dry weight basis.

The aerosol-generating substrate may alternatively or additionally comprise a non-tobacco-containing material. The aerosol-generating substrate may comprise homogenized plant-based material.

The aerosol-generating substrate may comprise, for example, one or more of: powder, granules, pellets, shreds, spaghettis, strips or sheets containing one or more of: herb leaf, tobacco leaf, fragments of tobacco ribs, reconstituted tobacco, homogenized tobacco, extruded tobacco and expanded tobacco.

The aerosol-generating substrate may comprise at least one aerosol-former. The aerosol-former may be any suitable known compound or mixture of compounds that, in use, facilitates formation of a dense and stable aerosol and that is substantially resistant to thermal degradation at the operating temperature of the aerosol-generating device. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may comprise other additives and ingredients, such as flavorants. The aerosol-generating substrate preferably comprises nicotine and at least one aerosol-former. In a particularly preferred embodiment, the aerosol-former is glycerine.

Preferably the aerosol-generating substrate comprises about 40% water by weight or less, such as about 30% or less, about 25% or less or about 20% or less. For example, the aerosol-generating substrate may comprise 5% to about 30% water by weight.

Preferably the aerosol-generating substrate is in solid form rather that in a fluid forms. Preferably the solid aerosol-generating substrate holds its shape. The solid aerosol-generating substrate may be in loose form, or may be provided in a suitable consumable such as container or cartridge.

The solid aerosol-forming substrate may be provided on or embedded in a thermally stable carrier. In a preferred embodiment, the carrier is a tubular carrier having a thin layer of the solid substrate deposited on its inner surface, or on its outer surface, or on both its inner and outer surfaces. Such a tubular carrier may be formed of, for example, a paper, or paper like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets.

The carrier may be a non-woven fabric or fiber bundle into which tobacco components have been incorporated. The non-woven fabric or fiber bundle may comprise, for example, carbon fibers, natural cellulose fibers, or cellulose derivative fibers.

Any suitable cartridge may contain the aerosol-generating substrate. The cartridge may comprise a housing in which the aerosol-generating substrate may be disposed. In embodiments wherein the heating element is configured to pierce the cartridge, the housing may define an opening through which the heating element may protrude. The opening may be covered with a foil or piercable polymeric material. In embodiments where the heating element is configured to surround at least a portion of the cartridge, the housing is preferably formed of thermally conductive material to allow the heat from the heating element to sufficiently heat the aerosol-generating substrate disposed in the housing.

The cartridge preferably comprises openings or vents through which air may flow. Alternatively, openings or vents may be formed in the cartridge during or after insertion of the cartridge in the receptacle of the device. For example, the shisha device may comprise elements configured to puncture the cartridge to form openings. Air that flows through the cartridge may entrain aerosolized constituents released from the aerosol-generating substrate when the substrate is heated.

The cartridge may comprise paper wrapped around the aerosol-generating article. For example, the cartridge and aerosol-generating article may comprise an elongate, cylindrical heatstick or a bundle of heatsticks.

The shisha device may comprise a control unit operably coupled to a power supply. The control assembly may be operably coupled to one or more heating elements to control the timing and extent to which the heating element heats the aerosol-generating substrate in the cartridge when the cartridge is received in a receptacle. For example, the control unit may cause the heating element to heat the aerosol-generating substrate to an extent that causes the aerosol-generating substrate in the cartridge to heat to a sufficient degree to form an aerosol without combusting the aerosol-generating substrate. If the device comprises more than one receptacle for receiving more than one cartridge comprising an aerosol-generating substrate, the control unit may independently control each heating element such that the aerosol-generating substrate in a first cartridge in a first receptacle is heated at a different time, a different temperature, or at a different time and temperature than an aerosol-generating substrate in a second cartridge in a second receptacle.

The control unit may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. The control unit may include memory that contains instructions that cause one or more components of the control unit or of the shisha device to carry out a function or aspect of the control unit. Functions attributable to the control unit in this disclosure may be embodied as one or more of software, firmware, and hardware.

A shisha device may include an alarm apparatus operably coupled to the control unit and power supply. Control unit may activate the alarm apparatus to provide a cue to a consumer to indicate when the aerosol-generating substrate in the cartridge is depleted or nearly depleted. Such a cue will alert the consumer to prepare to replace the one or more cartridges in the device. If the device holds more than one cartridge, the control unit is preferably configured to cause the alarm apparatus to provide a cue when the last cartridge to be heated is depleted or nearly depleted. Any suitable alarm apparatus may be employed. For example, the alarm apparatus may include, for example, sound generation apparatus and a speaker, a light, such as an LED, a display indicating amount of time left until depletion of the aerosol-generating substrate, or the like.

As used herein, "depleted," in the context of an aerosol-generating substrate, means that continued heating of the substrate results in no further production of aerosol from the substrate. "Nearly depleted" means that the production of aerosol with continued heating is substantially reduced relative to peak aerosol production. For example, aerosol production may be reduced by 50% or more, 70% or more, or 90% or more.

The shisha device may include apparatus for identifying the type of cartridge inserted into a receptacle. Information regarding cartridge identity may be used by the control unit to determine one or both of (i) the aerosol-generating life span of the aerosol-generating substrate in the cartridge, and (ii) the temperature, temperature ramp profile, etc. at which a heating element should be heated to sufficiently heat the aerosol-generating substrate in the cartridge to produce an aerosol without burning the substrate. The life span for a particular cartridge may be, for example, stored in a look-up table in memory based on typical usage of a shisha device or may be calculated by the control unit based on the heating profile employed during use of the particular cartridge inserted into the receptacle. The cartridge may include an identifying element. For example, the cartridge may include an RFID tag and the control unit may include, or be operably coupled to, a RFID reader. As another example, the cartridge may include an electronic identifying element that electrically couples to a reading element associated with a receptacle when the cartridge is inserted into the receptacle.

The shisha device may include aerosol detecting apparatus operably coupled to the control unit. The aerosol detecting apparatus and control unit may be configured to detect a decrease in production of aerosol. Upon detection in a decrease in aerosol production, the control unit may cause a next heating element in a next receptacle to heat the aerosol generating substrate in a cartridge received by the next receptacle, if the device contains more than one receptacle; may cause the alarm apparatus to provide a cue to a consumer that the aerosol-generating substrate in the receptacle is nearly depleted; or the like.

Any suitable aerosol detector may be employed. For example, the aerosol detector may comprise a photoelectric detector configured to detect aerosol in an air flow path of the device. The photoelectric detector may comprise a light emission source, such as an LED, and a photocell positioned to detect light emitted from the source. An increase in light detected by the photocell may be indicative of a decrease in aerosol being generated.

Reference will now be made to the drawings, which depict one or more aspects described in this disclosure. However, it will be understood that other aspects not depicted in the drawings fall within the scope and spirit of this disclosure. Like numbers used in the figures refer to like components, steps and the like. However, it will be understood that the use of a number to refer to a component in a given figure is not intended to limit the component in another figure labeled with the same number. In addition, the use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

FIGS. 1, 2, and 11 are schematic sectional views illustrating selected components of an example of a shisha device.

Figure 1:
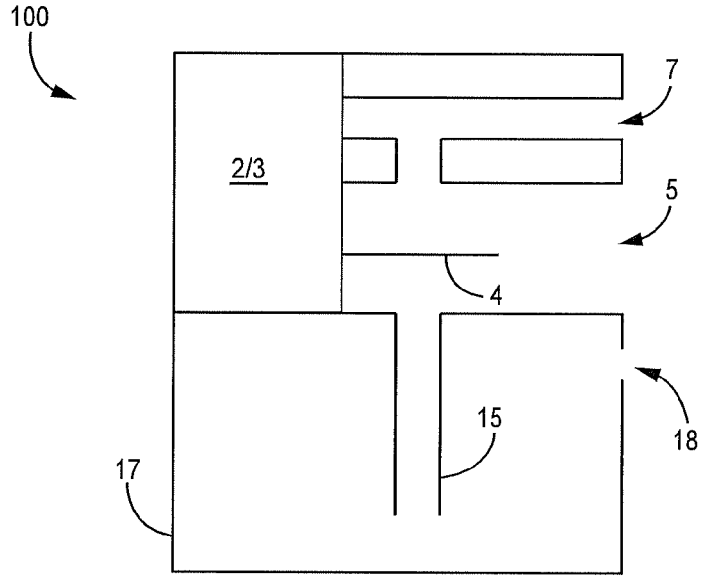
Figure 2:
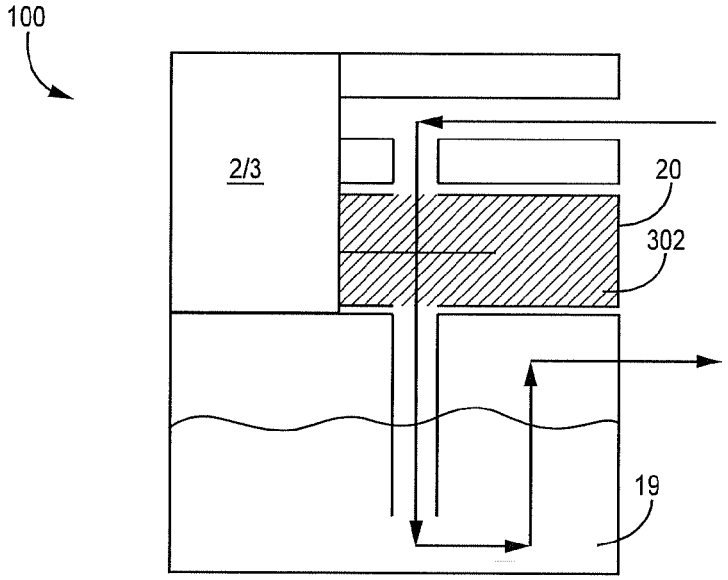

Referring now to FIGS. 1-2, a schematic drawing of an example of a shisha device 100 is shown. The device 100 includes a vessel 17 defining an interior volume configured to contain liquid 19 and defining an outlet 18. The liquid 19 preferably comprises water, which may optionally be infused with one or more colorants, flavorants or colorants or flavorants. For example, the water may be infused with one or both of botanical infusions or herbal infusions. The device 100 also comprises a receptacle 5 for receiving a cartridge 20 containing an aerosol-generating substrate 302. The device 100 also comprises a heating and control assembly 2 and power supply 3. The heating and control assembly 2 includes a heating element 4 configured to heat the aerosol-generating substrate 302 in the cartridge 20 to aerosolize constituents of the substrate. In the depicted embodiment, the heating element 4 extends into the receptacle 5. The device 100 also comprises a conduit 15 for carrying aerosolized constituents released from the aerosol-generating substrate 302 into the liquid 19 in the vessel 17.

In FIG. 2, a cartridge 20 containing aerosol-generating substrate 302 is received in receptacle 5 of the device 100. The heating element 4 pierces the cartridge 20 and projects into the aerosol-generating substrate 302.

An air flow path through the device 100, when the device 100 is in use, is shown by arrows in FIG. 2. When a user draws on outlet 18 or a hose coupled to the outlet 18, air enters inlet 7, flows through openings in cartridge 20 across the aerosol generating substrate 302 to entrain volatile compounds aerosolized by heating of the aerosol generating-substrate 302. The air flow carries the aerosolized constituents through the conduit 15, into the liquid 19, and out of outlet 18 for delivery to a user.

Figure 3:
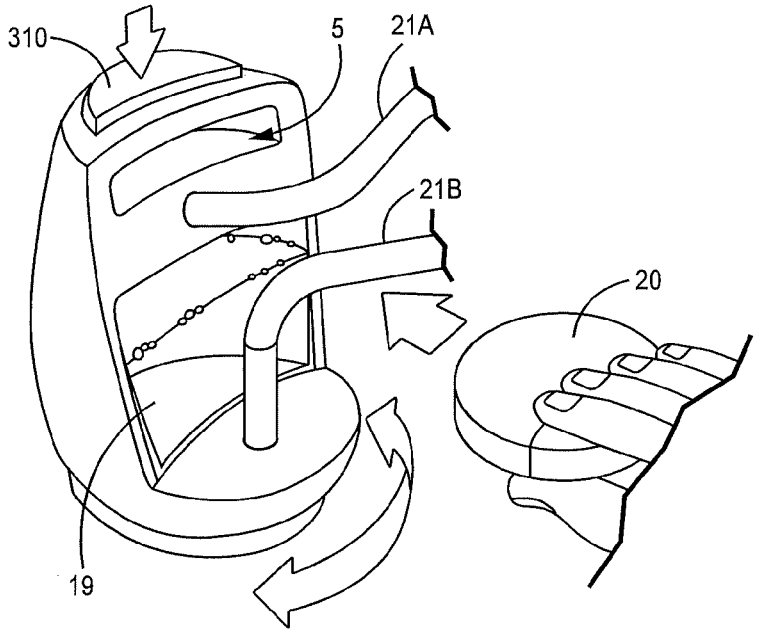
FIGS. 3-10 and 12 are schematic perspective views illustrating various components and examples of shisha devices.

Referring now to FIG. 3, a schematic drawing of an example of a shisha device is shown. The device comprises a receptacle 5 for receiving a cartridge 20 containing aerosol-generating substrate. The device also comprises an actuatable element 310 for one or more of switching on the device, puncturing the cartridge 20 to create openings for airflow through the cartridge, and causing heating elements to pierce the cartridge 20 to penetrate into aerosol-generating substrate contained in the cartridge. The depicted device may swivel about a base element to facilitate use by multiple users. Other portions of the device may swivel (not show) to facilitate use by multiple users. The depicted device also includes two hoses 21A, 21B coupled to two different outlets to facilitate use by multiple users.

Figure 4:
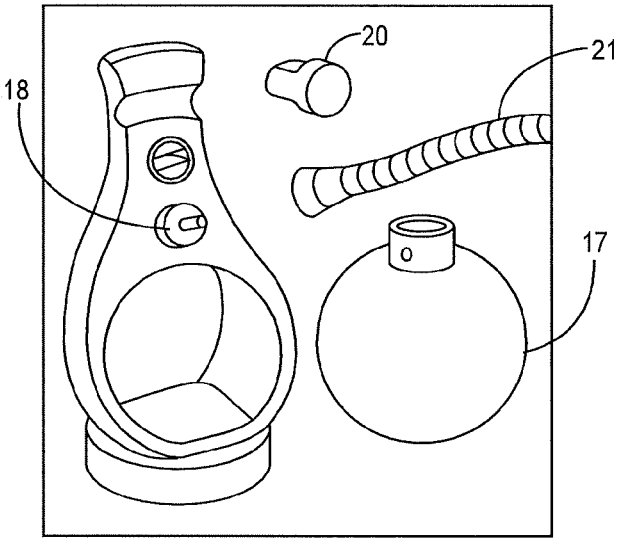
Figure 5:
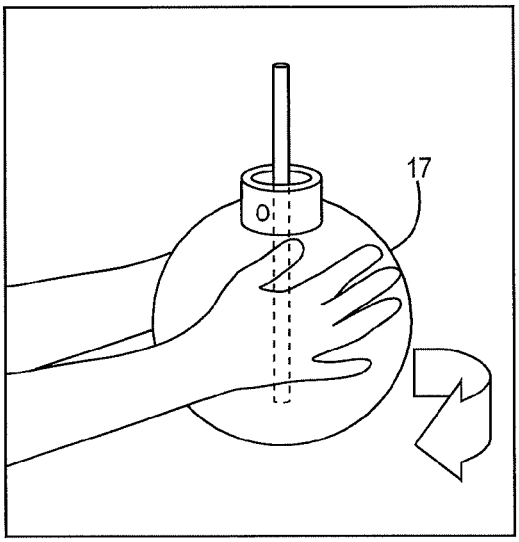
Figure 6:
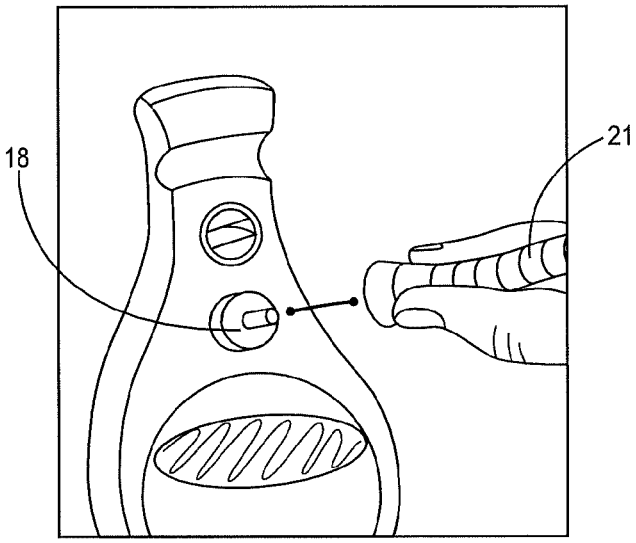
Figure 7:
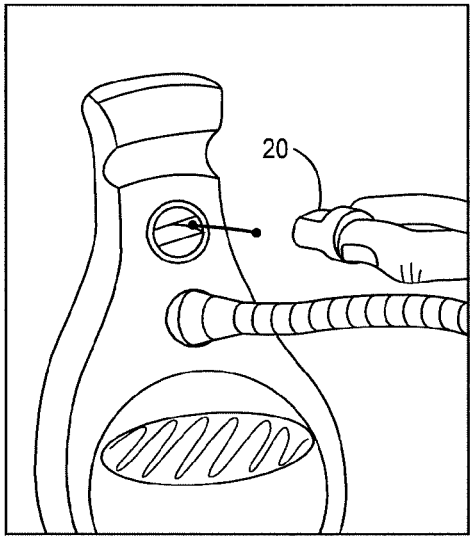
Figure 8:
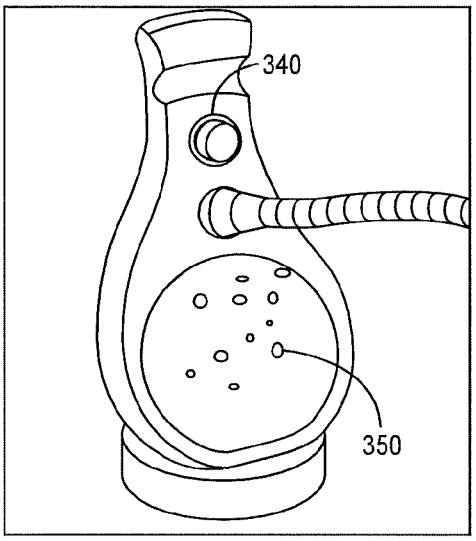

Referring now to FIGS. 4-8 schematic drawings of a shisha device are shown to illustrate use of the device. In FIG. 4 some components of the device are disassembled. For example, the cartridge 20 is not yet inserted into the receptacle, the hose 21 is not yet connected to the outlet 18, and the vessel 17 is removed from the main body of the shisha device. FIG. 5 illustrates that liquid may be dispensed into the disconnected vessel 17, which may then be reattached to the body by, for example, twisting. The vessel 17 may connect to the main body in any suitable manner, such as through a bayonette-type connection or a threaded connection. FIG. 6 illustrates connection of the hose 21 to the outlet 18. Any suitable connection may be used to connect the hose to the outlet. For example, a quick-release connection may be employed. The connection may comprise a spring collar, a bayonette-type connector, a threaded connector, a magnetic connector or any other suitable connection mechanism. FIG. 7 illustrated insertion of the cartridge 20 into the receptacle. FIG. 8 illustrates the device in use, in which bubbles 350 are formed in the liquid when a user draws on the end of the hose or a mouthpiece connected to the hose. The depicted device includes a ring light indicator 340 to provide a cue to a consumer that the device is activated and in use or ready for use.

Figure 9:
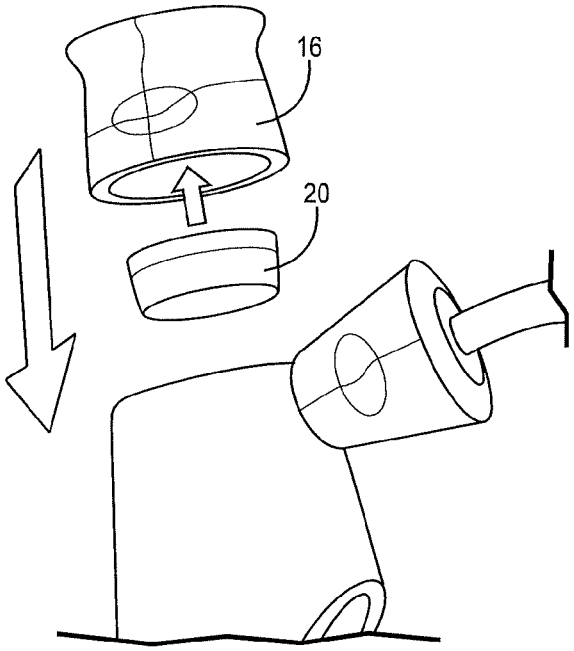

Referring now to FIG. 9, a schematic drawing of an example of a shisha device is shown. The device includes a cover 16 that forms a receptacle for receiving the cartridge 20. Once the cartridge 20 is inserted into the receptacle of the cover 16 the cover may be attached to the device.

Figure 10:
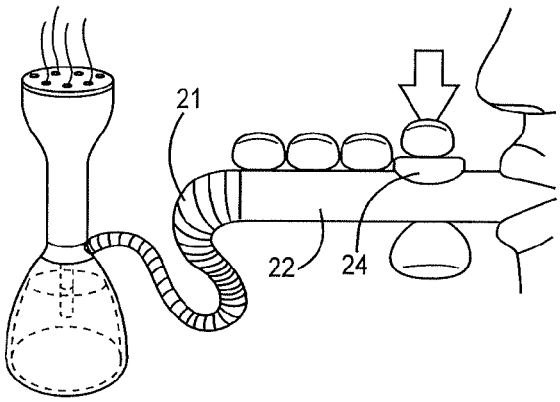

Referring now to FIG. 10, a schematic drawing of an example of a shisha device is shown. The device includes a mouthpiece 22 attached to the hose 21. The mouthpiece includes an actuatable element 24 to allow a consumer to manually activate the device. The actuatable element 24 may be in wireless communication with control electronics and activation of the element 24 may cause the control electronics to activate the heating element. Preferably, such manual activation is only enabled while the user puffs on the mouthpiece to prevent overheating or unnecessary heating of aerosol-generating substrate in the consumables.

Figure 11:
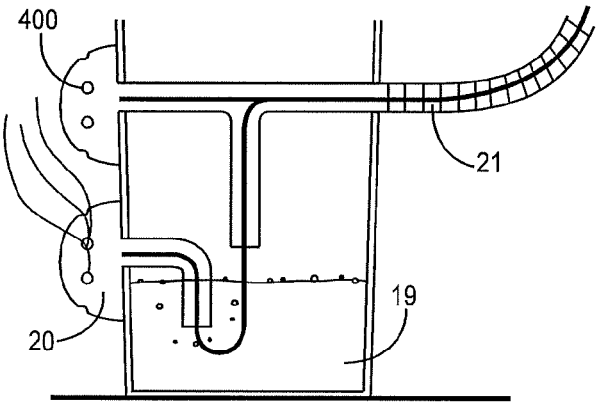

Referring now to FIG. 11, a schematic drawing of an example of a shisha device is shown. The device includes a first receptacle for receiving a cartridge 20 containing an aerosol-generating substrate and a second receptacle configured to receive a second cartridge containing a flavorant. The device is configured to include a first flow path that carries aerosolized constituents from the first cartridge 20 through the liquid 19 and out the outlet to the hose 21. The device also defines a second flow path from the second cartridge to the outlet and hose 21. The second flow path does not go through the liquid 19. Air from the two flow paths may mix at the outlet or in the hose 21 prior to delivery to a consumer.

Figure 12:
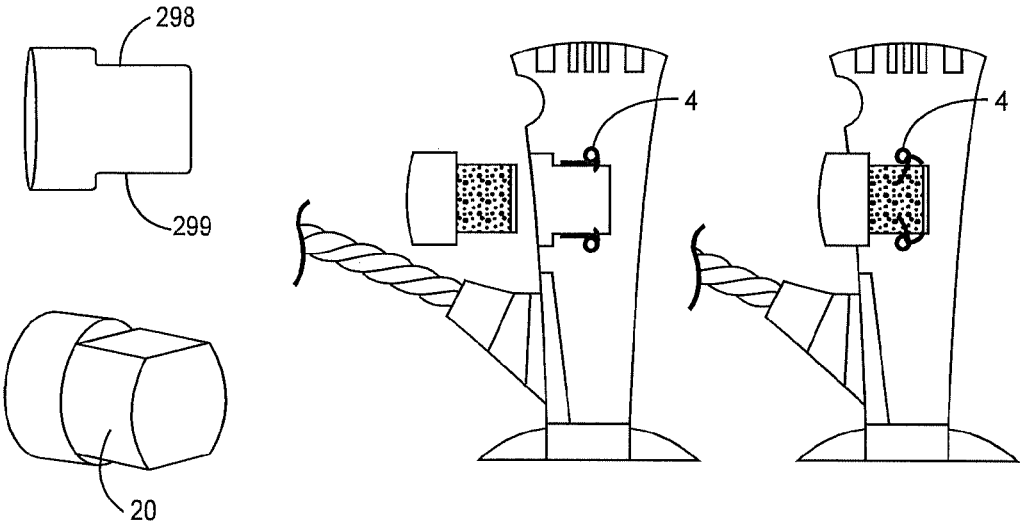

Referring now to FIG. 12, a schematic drawing of an example of a shisha device is shown. The device includes actuatable heating elements 4 that may move from a first position in which they do not extend into the receptacle to a second position in which they do extend into the receptacle. The depicted cartridge 20 includes a first piercable covering 298, such as a foil, and a second piercable covering 299. When the cartridge 20 is inserted into the receptacle the heating elements may pierce the coverings 298, 299 to protrude into the cartridge 20 when the heating elements 4 are actuated. In some examples, insertion of the cartridge into the receptacle causes the heating elements to be actuated.

Figure 13:
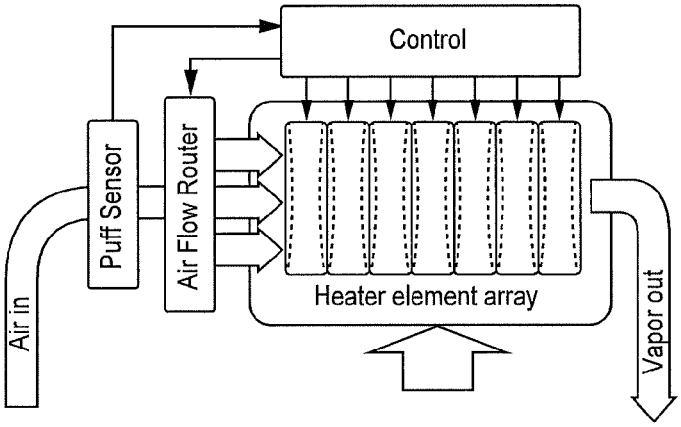
FIG. 13 is schematic diagram of air flow and a control electronic scheme.

Referring now to FIG. 13, a schematic diagram of air flow and a control electronic scheme is shown. The control electronics are operably coupled to a power supply (not shown). The depicted embodiment includes a puff sensor, which causes activation of one or more heating elements by the control electronics. The heating element comprises an array of heating elements. Each element of the array may, in some examples, be individually activated by the control electronics. This can allow heating of different portions of the aerosol generating substrate contained in the cartridge at different times. Such a scheme can cause the aerosol-generating substrate to used more efficiently or to last longer during a shisha session.

In some examples, the cartridge comprises a plurality of aerosol-generating substrates, each of which are configured to interact with separate heating elements when the cartridge is received by the receptacle of the shisha device. For example, the cartridge may comprise a packed array of heat sticks, such as Philip Morris IQOS heat sticks.

Figure 14:
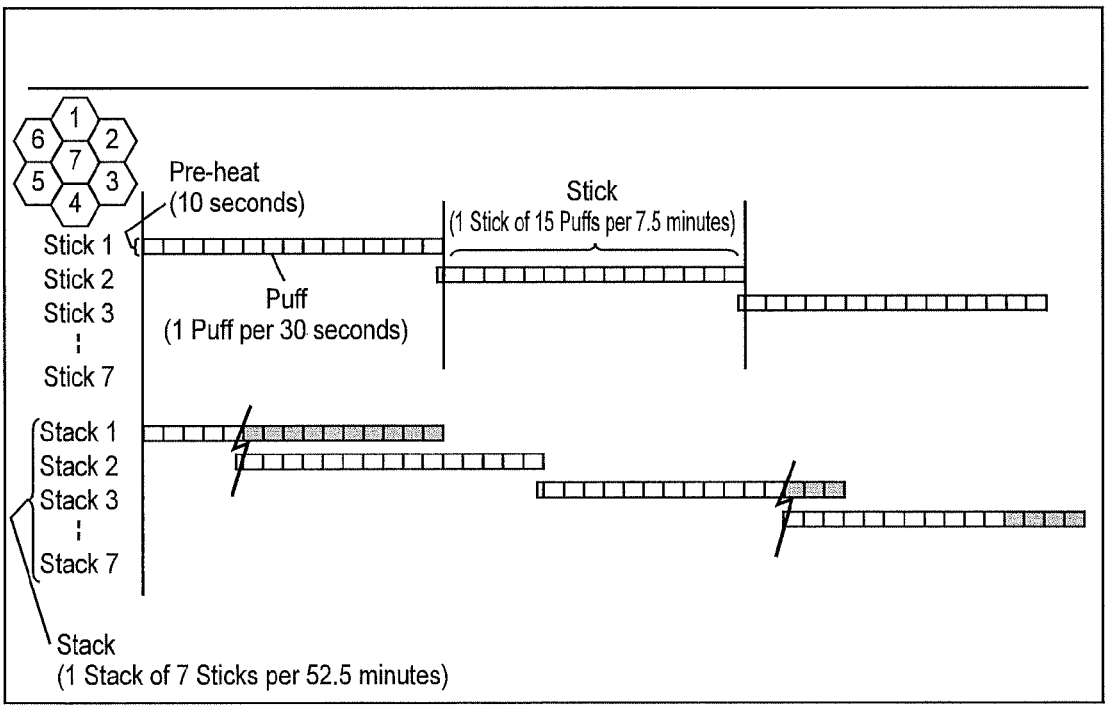
FIG. 14 is a schematic representation of an example of controlled sequential heating of seven heat sticks in a cartridge.

FIG. 14 shows an example of controlled sequential heating of seven heat sticks in a cartridge. Each heat stick may be configured to last about 7.5 minutes (with one puff about every 30 seconds). However, with sequential heating of the individual heat sticks in the cartridge, a shisha experience with the cartridge may last about 52.5 minutes.

A power supply unit of a shisha device may be a battery, or set of batteries. In embodiments that are mainly cylindrical embodiments the cathode and anode elements can be rolled and assembled to match such geometries using a hollow housing as described in various figures. The batteries of power supply unit can be rechargeable, as well as it may be removable and replaceable. Any suitable batter may be used. For example, heavy duty type or standard batteries existing in the market, such as used for industrial heavy duty electrical power-tools. Alternatively the power supply unit can be any type of electric power supply including a super or hyper-capacitor. Alternatively the device can be powered connected to an external electrical power source, and electrically and electronically designed for such purpose.

Regardless of the type of power supply employed, the power supply preferably provides sufficient energy for the normal functioning of the device for approximately 70 minutes of continuous operation of the device, before being recharged or needing to connect to an external electrical power source.

Preferably, assembly of all main parts of a shisha device of the invention assures hermetic functioning of the device. Hermetic function should assure that proper air flow management occurs. Hermetic functioning may be achieved in any suitable manner. For example, seals such as sealing rings and washers may be used to ensure hermetic sealing.

Control electronics of a shisha device of the invention may be provided in any suitable form and may, for example, include a controller or a memory and a controller. The controller can include one or more of an Application Specific Integrated Circuit (ASIC) state machine, a digital signal processor, a gate array, a microprocessor, or equivalent discrete or integrated logic circuitry. Control electronics can include memory that contains instructions that cause one or more components of the circuitry to carry out a function or aspect of the control electronics. Functions attributable to control electronics in this disclosure can be embodied as one or more of software, firmware, and hardware.

The control electronics may be configured to monitor the electrical resistance of the heating element, and to control the supply of power to the heating element dependent on the electrical resistance of the heating element.

The electronic circuitry may comprise a microprocessor, which may be a programmable microprocessor. The electronic circuitry may be configured to regulate a supply of power. The power may be supplied to the heater element in the form of pulses of electrical current.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Thus, methods, systems, apparatuses, assemblies and articles for shisha devices are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, electrical arts, and aerosol generating article manufacturing or related fields are intended to be within the scope of the following claims.

The invention claimed is:

1. A shisha device for use with a first cartridge containing an aerosol-generating substrate, wherein the first cartridge comprises a housing surrounding the aerosol-generating substrate, the shisha device comprising:

a vessel defining an interior configured to contain liquid and defining an outlet in communication with the interior of the vessel;

a first receptacle configured to receive the first cartridge; and a first electrical heating element configured to heat the aerosol-generating substrate in the first cartridge to generate an aerosol when the first cartridge is received by the first receptacle, wherein the first heating element is configured to heat the aerosol-generating substrate to an extent sufficient to generate an aerosol without combusting the aerosol-generating substrate, wherein the first heating element is actuatable from a first position in which the first heating element does not extend into the first receptacle to a second position in which the first heating element extends into the first receptacle, wherein actuation of the first heating element from the first position to the second position causes the first heating element to pierce the first cartridge when the first cartridge is received by the receptacle, wherein insertion of the first cartridge into the first receptacle causes the first heating element to move from the first position to the second position.

2. The shisha device according to claim 1, wherein the first heating element comprises a plurality of separately activatable zones configured to heat a separate portion of the aerosol-generating substrate in the first cartridge.

3. The shisha device according to claim 2, wherein the separately activatable zones are sequentially activatable.

4. The shisha device according to claim 1, further comprising:

a second receptacle configured to receive a second cartridge comprising a housing surrounding an aerosol generating substrate; and a second electrical heating element configured to heat the aerosol-generating substrate in the second cartridge to generate an aerosol when the second cartridge is received by the second receptacle, wherein the second heating element is configured to heat the aerosol-generating substrate to an extent sufficient to generate an aerosol without combusting the aerosol-generating substrate.

5. The shisha device according to claim 4, wherein the first receptacle is configured to receive a first cartridge comprising paper wrapped around the aerosol-generating article and wherein the second receptacle is configured to receive a second cartridge comprising paper wrapped around the aerosol-generating article.

6. The shisha device according to claim 4, wherein the first and second heating elements are separately activatable.

7. The shisha device according to claim 4, wherein the shisha device further comprises an aerosol detection apparatus and a control unit, wherein the aerosol detection apparatus is operably coupled to the control unit, and wherein the aerosol detection apparatus and the control unit are configured to detect a decrease in production of aerosol, wherein the aerosol detection apparatus comprises a photoelectric detector, and wherein the shisha device is configured to activate the first heating element until a decrease in production of aerosol is detected.

8. The shisha device according to claim 7, wherein the wherein the control unit is configured to activate the second heating element upon the detection of the decrease in the production of aerosol.

9. The shisha device according to claim 1, further comprising:

two or more additional receptacles, each configured to receive an additional cartridge comprising a housing surrounding an aerosol generating substrate; and two or more additional electrical heating elements, each configured to heat the aerosol-generating substrate in the additional cartridges to generate an aerosol when the additional cartridges are received by the additional receptacles, wherein the additional heating elements are configured to heat the aerosol-generating substrate in the additional cartridges to an extent sufficient to generate an aerosol without combusting the aerosol-generating substrate.

10. The shisha device according to claim 9, wherein the shisha device further comprises an aerosol detection apparatus and a control unit, wherein the aerosol detection apparatus is operably coupled to the control unit, wherein the aerosol detection apparatus and the control unit are configured to detect a decrease in production of aerosol, wherein the aerosol detection apparatus comprises a photoelectric detector, wherein the shisha device is configured to activate the first heating element until a decrease in production of aerosol is detected, and wherein the control unit is configured to activate each additional electrical heating element in a sequential fashion in response detection of a decrease in production of aerosol from the previously heated additional cartridge.

11. The shisha device according to claim 1, further comprising a separate receptacle configured to receive a separate cartridge, wherein the device, in use, forms an airflow path through the separate receptacle and to the outlet without being drawn through the liquid disposed in the vessel.

12. The shisha device according to claim 1, further comprising a mouthpiece operably coupled to the outlet, wherein the mouthpiece comprises an actuatable element operably coupled to the heating element, such that actuation of the element causes the heating element to be activated.

13. The shisha device according to claim 1, further comprising alert apparatus, wherein the alert apparatus is configured to cause a cue to be provided to a consumer when the aerosol-generating substrate in the first cartridge is depleted or nearly depleted.

* * * * *